US009217425B2

(12) United States Patent
Looi et al.

(10) Patent No.: US 9,217,425 B2
(45) Date of Patent: Dec. 22, 2015

(54) DIAPHRAGM PUMP WITH INLET PATHWAYS PASSING THROUGH MOUNTING HOLES

(75) Inventors: Wan Hor Looi, Hong Kong (CN); Hong Yi Zeng, Shenzhen (CN); Samuel Agustin Cuaresma, Jr., Hong Kong (CN)

(73) Assignee: JOHNSON ELECTRIC S.A., Murten (CH)

( * ) Notice: Subject to any disclaimer, the term of this patent is extended or adjusted under 35 U.S.C. 154(b) by 412 days.

(21) Appl. No.: 13/493,649

(22) Filed: Jun. 11, 2012

(65) Prior Publication Data

US 2012/0315166 A1 Dec. 13, 2012

(30) Foreign Application Priority Data

Jun. 10, 2011 (CN) ..... 2011 1 0159146

(51) Int. Cl.

| | |
|---|---|
| ***F04B 43/00*** | (2006.01) |
| ***F04B 45/02*** | (2006.01) |
| ***F04B 45/027*** | (2006.01) |
| ***F04B 9/04*** | (2006.01) |
| ***F04B 43/02*** | (2006.01) |
| ***F04B 45/04*** | (2006.01) |
| ***F04B 45/047*** | (2006.01) |

(52) U.S. Cl.

CPC ..... *F04B 43/0045* (2013.01); *F04B 9/045* (2013.01); *F04B 43/026* (2013.01); *F04B 45/022* (2013.01); *F04B 45/027* (2013.01); *F04B 45/043* (2013.10); *F04B 45/047* (2013.01)

(58) Field of Classification Search

CPC ..... F04B 43/04; F04B 43/025; F04B 45/022; F04B 45/027; F04B 45/043; F04B 45/047; F04B 43/0045; F04B 9/045; F04B 43/026; F04B 27/12; F04B 27/18; F04B 27/1018; F04B 49/225; F04B 1/122; F04B 1/182; F04B 45/04; F04B 43/02; F04B 43/045

USPC ..... 417/269, 271, 413.1, 539, 569, 570, 417/571

See application file for complete search history.

(56) References Cited

U.S. PATENT DOCUMENTS

| | | | | |
|---|---|---|---|---|
| 2,797,647 A * | 7/1957 | Floraday | ..... | F04B 1/124 417/269 |
| 3,900,276 A | 8/1975 | Dilworth | | |
| 4,153,391 A * | 5/1979 | Hartley | ..... | 417/269 |

(Continued)

FOREIGN PATENT DOCUMENTS

JP 2004011579 A 1/2004

*Primary Examiner* — Devon Kramer
*Assistant Examiner* — Jon Hoffmann
(74) *Attorney, Agent, or Firm* — Muncy, Geissler, Olds & Lowe P.C.

(57) ABSTRACT

A diaphragm pump includes a motor, an eccentric member driven by the motor, and a diaphragm. The motor includes an output shaft connected with the eccentric member. The eccentric member includes multiple arms which move up and down due to the rotation of the output shaft. The diaphragm has multiple bladders. Each bladder forms a pump chamber. The bladders are connected with the arms such that the bladders are compressed or expanded due to the movement of the arms. The pump has an air exhaust chamber and an air inlet chamber. The air inlet chamber is connected to the pump chambers via a passage. The passage includes a cavity which overlaps the air exhaust chamber in an axial direction of the motor.

12 Claims, 3 Drawing Sheets

(56) References Cited

U.S. PATENT DOCUMENTS

| | | | | | |
|---|---|---|---|---|---|
| 4,762,470 | A * | 8/1988 | Wang | F04B 39/108 181/264 |
| 4,863,356 | A * | 9/1989 | Ikeda et al. | 417/269 |
| 5,032,060 | A * | 7/1991 | Kobayashi et al. | 417/222.1 |
| 5,332,370 | A * | 7/1994 | Nakayama et al. | 417/413.1 |
| 5,362,208 | A * | 11/1994 | Inagaki et al. | 417/269 |
| 5,549,082 | A * | 8/1996 | Kobayashi | H01T 13/03 123/143 C |
| 6,158,971 | A * | 12/2000 | Takagi | 417/244 |
| 6,206,664 | B1 * | 3/2001 | Kakizawa | 417/569 |
| 6,364,636 | B1 | 4/2002 | Chang | |
| 6,382,928 | B1 * | 5/2002 | Chang | 417/269 |
| 6,506,033 | B2 * | 1/2003 | Fukami | 417/420 |
| 6,837,691 | B2 * | 1/2005 | Tarutani et al. | 417/269 |
| 6,843,643 | B2 * | 1/2005 | Fukami et al. | 417/413.1 |
| 2003/0031571 | A1 * | 2/2003 | Yamakawa | 417/412 |
| 2003/0068234 | A1 * | 4/2003 | Shindo | 417/269 |
| 2005/0047934 | A1 * | 3/2005 | Nawa | 417/357 |
| 2007/0160485 | A1 * | 7/2007 | Huang | 417/473 |
| 2009/0238697 | A1 * | 9/2009 | Sato et al. | 417/269 |

* cited by examiner

DIAPHRAGM PUMP WITH INLET PATHWAYS PASSING THROUGH MOUNTING HOLES

CROSS REFERENCE TO RELATED APPLICATIONS

This non-provisional patent application claims priority under 35 U.S.C. §119(a) from Patent Application No. 201110159146.7 filed in The People's Republic of China on Jun. 10, 2011.

FIELD OF THE INVENTION

This invention relates to a diaphragm pump and in particular, to a miniature diaphragm pump.

BACKGROUND OF THE INVENTION

A typical miniature diaphragm pump includes a base, and a diaphragm mounted to one side of the base. The miniature diaphragm pump defines an air inlet chamber in the base and further defines an air exhaust chamber outside the base. The air exhaust chamber is separate from the air inlet chamber. The diaphragm includes multiple air bags received in the air inlet chamber. Each air bag defines a pump chamber therein, and the pump chamber communicates with the air inlet chamber and the air exhaust chamber via a first passage and a second passage, respectively. A first valve is formed on the diaphragm aligned with the first passage, to thereby join or cut the communication between the pump chamber and the air inlet chamber. A second valve is aligned with the second passage, to thereby join or cut the communication between the pump chamber and the air exhaust chamber. The first passage is formed as a through hole in the base and provides a shortest path for the air intake.

The air bags are driven by an eccentric assembly, and the eccentric assembly is driven by a motor. When the motor works, the air bags are caused to be expanded or compressed due to the movement of the eccentric assembly, thereby sucking air from the air inlet chamber or exhausting air into the air exhaust chamber. However, during the air intake portion of the pumping cycle, undesired audible noise raises in the miniature diaphragm pump.

Therefore, there is a desire for an improved diaphragm pump, especially one which can be made in a small or miniature size.

SUMMARY OF THE INVENTION

Accordingly, the present invention provides a diaphragm pump comprising: a motor comprising an output shaft; an eccentric member driven by the output shaft, the eccentric member comprising a plurality of arms moving up and down due to rotation of the output shaft; a diaphragm comprising a plurality of bladders, each of the bladders forming a pump chamber, the bladders being connected with arms of the eccentric member, respectively, such that the pump chambers are compressed and expanded due to movement of the arms; an air exhaust chamber communicating with the pump chambers via channels; a plurality of first valves arranged to control the flow of air through the channels; an air inlet chamber communicating with the pump chambers via a passage; a cavity forming a part of the passage; and a plurality of second valves arranged to control the flow of air into the pump chambers from the cavity.

Preferably, the passage extends from the air inlet chamber to the cavity along a first direction initially and then from the cavity to the pump chambers along a second direction substantially opposite to the first direction.

Preferably, the cavity at least partially overlaps the air exhaust chamber in an axial direction of the motor.

Preferably, a plurality of mounting holes are formed in sidewalls that define the air inlet chamber and the air exhaust chamber, the mounting holes form pathways, which forms a part of the passage between the air inlet chamber and the cavity.

Preferably, a base, a holder, an air guide plate and a casing are provided, wherein the base and the holder cooperatively define the air inlet chamber, the air guide plate and the casing cooperatively define the air exhaust chamber, and the pathways pass through the holder, the air guide plate and the casing.

Preferably, a cover plate covers one side of the casing, the cover plate and the casing cooperatively defining the cavity.

Preferably, the casing and the air guide plate each define though holes forming a part of the passage and arranged to communicate the cavity with the pump chambers.

Preferably, the second valves are disposed between the casing and the air guide plate.

Preferably, a seal is mounted to a surface of the air guide plate, and the second valves are formed by the seal.

Preferably, the air inlet chamber is disposed between the motor and the air guide plate, the exhaust chamber is disposed on the side of the air guide plate remote from the motor and the cavity is disposed on the side of the exhaust chamber remote from the motor, the cavity being connected to the air inlet chamber by at least three pathways passing through the mounting holes.

According to a second aspect thereof, the present invention also provides a diaphragm pump comprising: a motor comprising an output shaft; an eccentric member driven by the output shaft of the motor, the eccentric member comprising a plurality of arms that move up and down due to rotation of the output shaft; a diaphragm comprising a plurality of bladders, each of the bladders defining a pump chamber, the bladders being connected with the arms of the eccentric member, respectively, such that the pump chambers are compressed and expanded by movement of the arms; an air exhaust chamber communicating with the pump chamber of each bladder via a channel; an air inlet chamber separate from the air exhaust chamber, the air inlet chamber communicating with the pump chamber via a passage and accommodating the eccentric member; and a cavity disposed adjacent the air exhaust chamber on a side remote from the air inlet chamber, the cavity forming a part of the passage.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
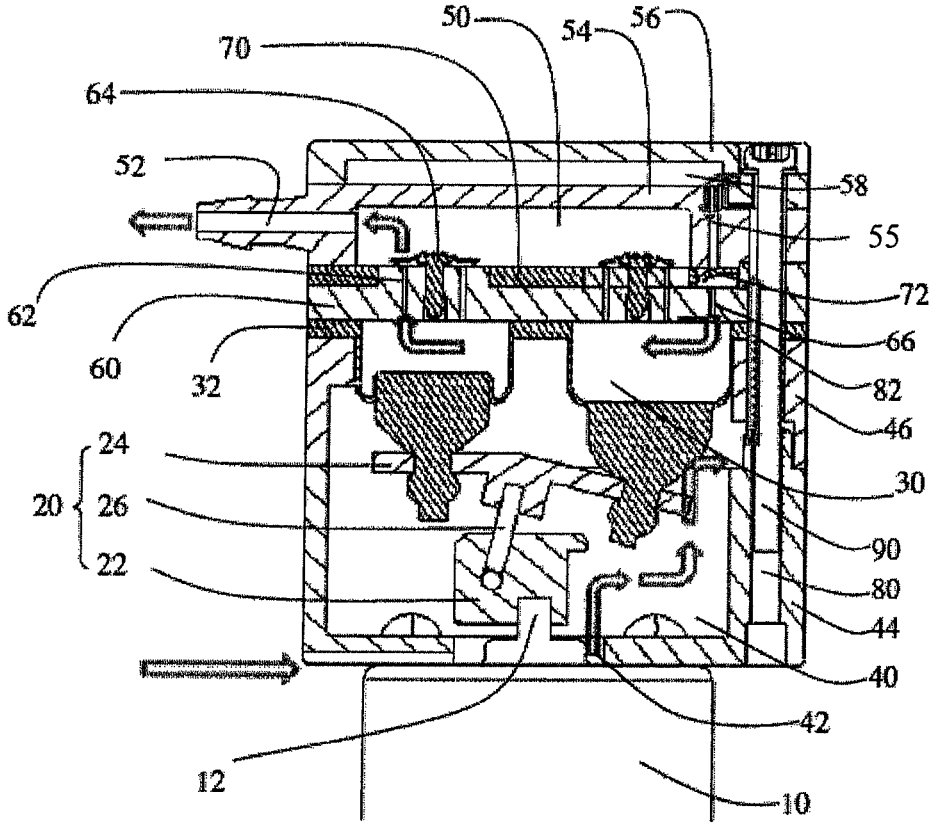
FIG. 1 is a sectional view of a miniature diaphragm pump according to an exemplary embodiment of the present invention.
Figure 2:
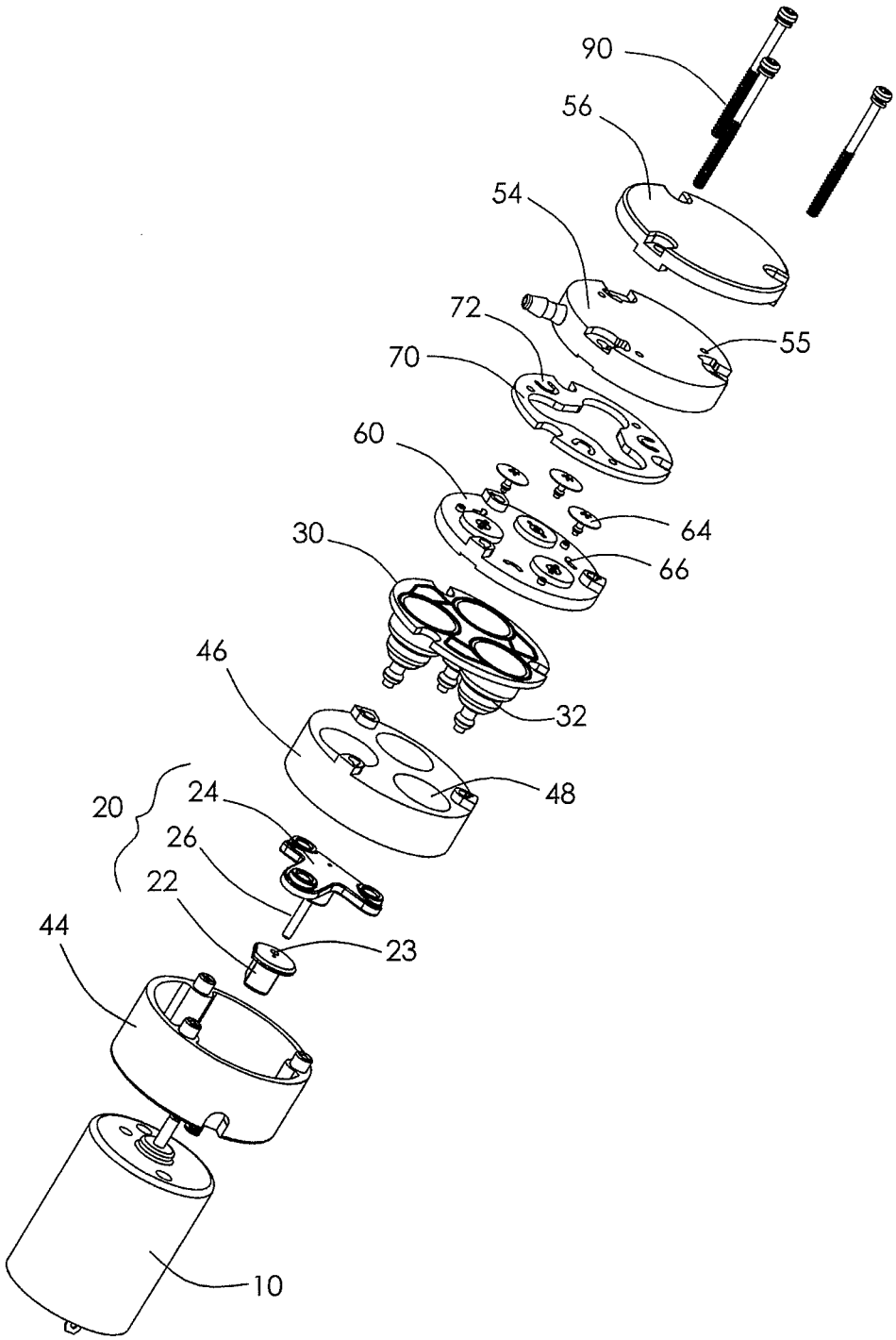
FIG. 2 is an exploded isometric view of the pump of FIG. 1.
Figure 3:
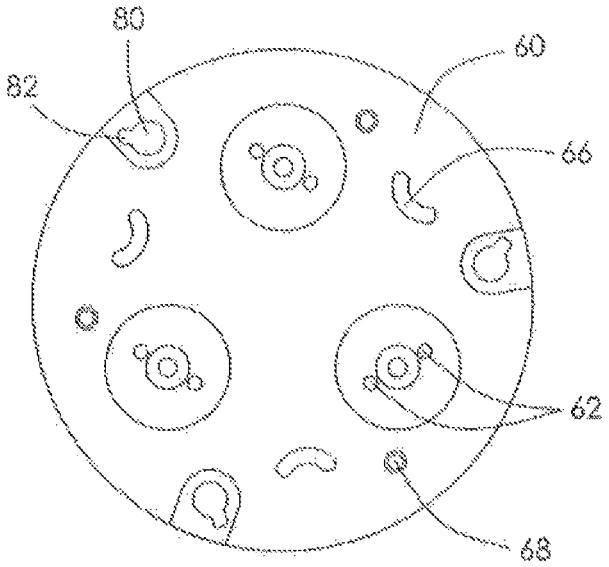
FIG. 3 is a plan view of a seal of the pump of FIG. 1.

Referring to FIGS. 1 through 3, a miniature diaphragm pump according to an exemplary embodiment of the present invention includes a motor 10 and a compressor assembly. The motor 10 includes an output shaft 12 to drive the compressor assembly.

The compressor assembly includes an eccentric member 20, and a diaphragm 30 having a plurality of bladders 32. Each of the bladders 32 forms a pump chamber with an opening formed at one end of the pump chamber. Preferably, the bladders 32 are like air bags and made from flexible material, such as rubber.

The eccentric member 20 includes a cam 22, a driver 24 and a connecting shaft 26 connecting the driver 24 to the cam 22. The cam 22 is fixed to the output shaft 12 of the motor 10 and thereby integrally rotates with the output shaft 12. The cam 22 has a receiving hole 23 extending along a direction that is nonparallel to the output shaft 12. One axial end of the connecting shaft 26 is rotatably received in the receiving hole 23. The other axial end of the connecting shaft 26 is fixed to the driver 24. Alternatively, the connecting shaft is integrally formed with the driver 24. The driver 24 includes a plurality of arms extending radially of the connecting shaft. When the cam 22 rotates with the output shaft 12, the axial end of the connecting shaft 26 inserted in the cam 22, moves with the cam 22 along a circular track, thus causing the arms of the driver 24 to move up and down, as the driver can not rotate.

The pump includes an air inlet chamber 40, an air exhaust chamber 50 and an air guide plate 60 separating the air inlet chamber 40 and the air exhaust chamber 50. The air inlet chamber 40 communicates with an outside environment via an air inlet 42, and the air exhaust chamber 50 communicates with the outside environment via an air outlet 52.

The air inlet chamber 40 is formed by two cooperating cavities defined in a base 44 and a holder 46. The base 44 is fixedly connected to the motor 10 with the eccentric member 20 received in the air inlet chamber 40. The air inlet 42 is defined in the base 44, optionally as a groove in an outer surface of an end wall of the base joining with a hole in the base receiving the shaft and a bearing boss of the motor. Preferably, the base 44 and the holder 46 both are cylindrical.

The diaphragm 30 is sandwiched between the holder 46 and the air guide plate 60, with the bladders 32 extending through holes 48 of the holder 46 and in to the air inlet chamber 40. A distal end of each bladder 32 is connected to a corresponding arm of the driver 24. When the arms of the driver 24 move up and down due to the rotation of the cam 22, the corresponding bladder 32 is caused to be compressed or expanded.

The air exhaust chamber 50 is formed between a casing 54 and the air guide plate 60. The air outlet 52 is formed on the casing 54. A cover plate 56 covers an axial end of the casing 54 remote from the air guide plate 60. The cover plate 56 and the casing 54 cooperatively define a cavity 58 therein.

The air guide plate 60 defines a plurality of air channels 62 corresponding to each pump chamber. Each pump chamber communicates with the air exhaust chamber 50 via the air channels 62, thus air in the pump chamber can enter into the air exhaust chamber 50 via the air channels 62. A plurality of first valves 64 are mounted on the air guide plate 60, and respectively aligned with the air channels 62 in the air guide plate 60.

The air inlet chamber 40 communicates with each pump chamber via a long and narrow passage, which extends out of the air inlet chamber 40. The air guide plate 60 defines a plurality of though holes 66 therein. A seal 70, preferably in the form of a rubber sheet, is disposed between the air guide plate 60 and the casing 54 to seal the air exhaust chamber 50. The seal 70 includes a plurality of second valves 72 arranged to seal the through holes 66 in the air guide plate 60. The second valves are flap valves allowing air to enter the pump chamber from the cavity 58 but preventing air flow in the opposite direction. Small spigots 68 may be provided on the air guide plate 60 to assist alignment and assembly of the seal 70 to the upper surface of the air guide plate.

The base 44, the holder 46, the air guide plate 60, the casing 54 and the cover 56 have axially aligned holes forming mounting holes 80. Fasteners 90, such as screws extend through the mounting holes 80 to connect the base 44, the holder 46, the air guide plate 60, the casing 54 and the cover 56 together. The mounting holes 80, at least where they pass through the holder 46, the air guide plate 60 and the casing 54, have an expanded portion in a radial direction, so as to cooperatively form pathways 82. The pathways 82 connect the air inlet chamber 40 with the cavity 58 formed by the casing 54 and the cover 56. The casing 54 has though holes 55 aligned with the through holes 66 in the air guide plate 60, so as to communicate the cavity 58 with the corresponding pump chamber. That is to say, the pathways 82, the cavity 58, the through holes 55, and the through holes 66 cooperatively form the passage. The second valve 72 is located between the though hole 55 in the casing 54 and the through hole 66 in the air guide plate 60.

During operation, when the bladder 32 is in an expanded state due to the movement of the arm of the driver 24, a low pressure is formed in the pump chamber causing the corresponding second valve 72 to open, drawing in air from the air inlet chamber 40 via the passage and cavity 58 and passing through the second valve 72. At the same time, the first valve 64 is closed tightly to prevent air in the exhaust chamber from returning to the pump chamber. When the bladder 32 is compressed due to the movement of the arm of the driver 24, the air in the pump chamber is compressed forming a high pressure area causing the corresponding first valve 64 to open and the air in the pump chamber passes into the air exhaust chamber 50, and then exits the pump via the air outlet 52. At the same time, the second valve 72 is closed tightly to prevent the air in the pump chamber from returning to the cavity 58 or air inlet chamber 40 via the passage.

Figure 4:
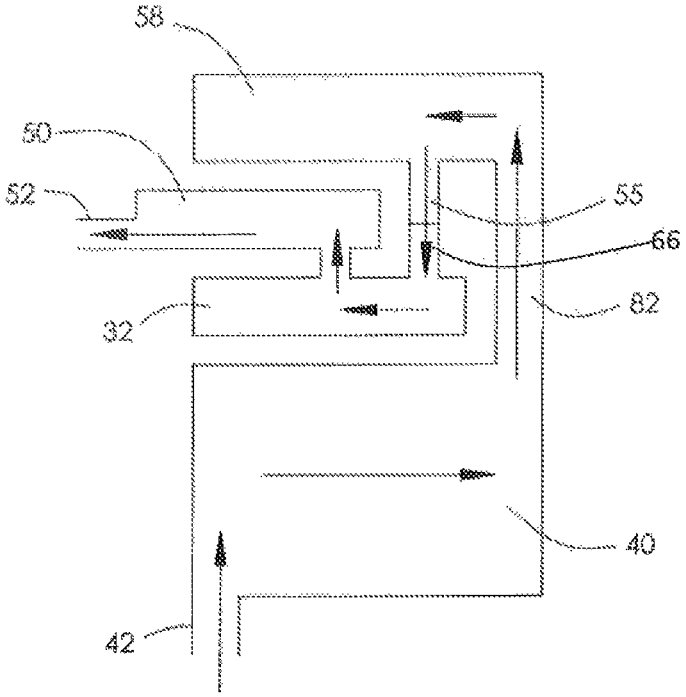
FIG. 4 is an airflow schematic diagram showing the direction of air flow in the pump of FIG. 1.

As illustrated in FIG. 4 and as described above, the passage for the intake of air extends along a first direction, through pathways 82, and then extends back along a second direction substantially opposite to the first direction, through holes 55, 66. The passage is thus long which extends the distance that the noise from the pump chamber travels along the intake passage and thus reduces the volume of the noise from the air intake path during pumping. Further, the passage 82 is roundabout, meaning that it does not take a direct path from the inlet to the pump chamber, making a maze for the noise to travel when the air is being sucked into the pump chamber. Therefore, the noise produced by the pump is significantly reduced.

While the science behind the noise reduction is not fully understood, it is thought that the cavity 58, in addition to the air inlet chamber 40, provides a stabilizing effect on the air intake pressure resulting in a lower noise emanating for the air intake of the pump. In addition, as shown more clearly in FIG.

4, the air enters the pumping chambers via narrow paths from the cavity 58. Thus cavity 58 helps to stabilize the air pressure of the air intake passages between the three pump chambers. Cavity 58 also acts as an initial noise attenuator by providing a relatively large volume between the pathways 82 and the through holes 55. Cavity 58 draws air from the air inlet chamber 40 via pathways 82 which are formed by the mounting holes 80, which are long and narrow which further helps to stabilize the air pressure within the pathway. Air inlet chamber 40 has a volume that is larger that the volume of cavity 58 which further stabilizers the air pressure of the air intake and the air entering the air inlet chamber via the air inlet is relatively steady, emitting a perceived lower noise and more acceptable sound from the air inlet.

Also the air from the pump chamber is exhausted through an exhaust chamber 50 before reaching the air outlet, again providing a stabilizing of the air pressure and thus a softening or lessening of the sound generated by the air exiting the pump.

The pump of the present invention has a particular application for use in inkjet printers, and has an application for use in medical treatment equipment, such as sphygmomanometers, drug syringes, and also has an application for use as air pumps for the lumber support mechanisms of seats for passenger vehicles, and so on.

It should be understood that while the air inlet chamber is described as being connected to the pump chambers by a passage, the passage may be formed by any number of individual connections, not just three as shown in the preferred embodiment.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A diaphragm pump comprising:

a motor comprising an output shaft;

an eccentric member driven by the output shaft, the eccentric member comprising a plurality of arms moving up and down due to rotation of the output shaft;

a diaphragm comprising a plurality of bladders, each of the bladders forming a pump chamber, the bladders being connected with arms of the eccentric member, respectively, such that the pump chambers are compressed and expanded due to movement of the arms;

an air exhaust chamber communicating with the pump chambers via channels;

a plurality of first valves arranged to control the flow of air through the channels;

an air inlet chamber communicating with the pump chambers via a passage for supplying air to the pump chambers via the passage;

a cavity forming a part of the passage;

a plurality of second valves arranged to control the flow of air into the pump chambers from the cavity;

an air guide plate in which the channels are formed;

a base;

a holder, the base and the holder cooperatively defining the air inlet chamber; and a casing, the air guide plate and the casing cooperatively defining the air exhaust chamber, wherein the air inlet chamber and the air exhaust chamber are respectively located at opposite sides of the air guide plate, and wherein a plurality of mounting holes are formed in sidewalls that define the air inlet chamber and the air exhaust chamber, the mounting holes form pathways, which forms a part of the passage between the air inlet chamber and the cavity, the pathways passing through the holder, the air guide plate and the casing.

2. The pump of claim 1, wherein the passage extends from the air inlet chamber to the cavity along a first direction initially and then from the cavity to the pump chambers along a second direction opposite to the first direction.

3. The pump of claim 1, wherein the cavity at least partially overlaps the air exhaust chamber in a direction perpendicular to an axial direction of the motor.

4. The pump of claim 1, further comprising a cover plate covering one side of the casing opposite from the air exhaust chamber, the cover plate and the casing cooperatively defining the cavity.

5. The pump of claim 4, wherein the casing and the air guide plate each define though holes forming a part of the passage and arranged to communicate the cavity with the pump chambers.

6. The pump of claim 5, wherein the second valves are disposed between the casing and the air guide plate.

7. The pump of claim 6, further comprising a seal mounted to a surface of the air guide plate, and the second valves are formed by the seal.

8. The pump of claim 7, wherein the air inlet chamber is disposed between the motor and the air guide plate, the exhaust chamber is disposed on the side of the air guide plate remote from the motor and the cavity is disposed on the side of the exhaust chamber remote from the motor, the cavity being connected to the air inlet chamber by at least three pathways passing through the mounting holes.

9. The pump of claim 1, wherein the air inlet chamber has a volume that is larger than the volume of the cavity.

10. The pump of claim 1, wherein the air inlet chamber and the cavity are respectively located at opposite sides of the air exhaust chamber.

11. The pump of claim 1, wherein the cavity is a single cavity which is capable of communicating with anyone of the pump chambers when a corresponding one of the second valves is open.

12. A diaphragm pump comprising:

a motor comprising an output shaft;

an eccentric member driven by the output shaft of the motor, the eccentric member comprising a plurality of arms that move up and down due to rotation of the output shaft;

a diaphragm sandwiched between a holder and an air guide plate, the diaphragm comprising a plurality of bladders, each of the bladders defining a pump chamber, the bladders being connected with the arms of the eccentric member, respectively, such that the pump chambers are compressed and expanded by movement of the arms;

an air exhaust chamber formed between a easing and the air guide plate, the air exhaust chamber communicating with the pump chamber of each bladder via a channel defined in the air guide plate;

an air inlet chamber separate from the air exhaust chamber, the air inlet chamber communicating with the pump chamber via a passage and accommodating the eccentric member; and a cover plate covering one side of the casing opposite from the air exhaust chamber, the cover plate and the easing cooperatively defining a cavity, the casing being located between the cavity and the air exhaust chamber, the cavity forming a part of the passage and connected between the air inlet chamber and the pump chamber, the passage extending from the air inlet chamber to the cavity along a first direction initially and then from the cavity to the pump chambers along a second direction opposite to the first direction.

* * * * *